United States Patent [19]

Hayes et al.

[11] Patent Number: 5,030,132

[45] Date of Patent: Jul. 9, 1991

[54] BIDIRECTIONAL INSULATION DISPLACEMENT ELECTRICAL CONTACT TERMINAL

[75] Inventors: Earl J. Hayes, Advance; Allan J. Sykora, Kernersville, both of N.C.

[73] Assignee: AMP Incorporated, Harrisburg, Pa.

[21] Appl. No.: 134,391

[22] Filed: Dec. 17, 1987

[51] Int. Cl.[5] ..... H01R 4/24

[52] U.S. Cl. ..... 439/397; 439/399; 439/400

[58] Field of Search ..... 439/217, 224, 371, 389–404, 439/407, 408, 421, 430, 442, 443, 877, 879, 880, 881

[56] References Cited

U.S. PATENT DOCUMENTS

| | | | |
|---|---|---|---|
| 3,842,392 | 10/1974 | Aldridge et al. | 339/47 R |
| 3,950,065 | 4/1976 | Renn | 339/98 |
| 3,977,754 | 8/1976 | Brummans | 339/99 R |
| 3,979,615 | 9/1976 | Neff | 339/95 D |
| 4,019,801 | 4/1977 | Hoffman | 339/98 |
| 4,039,239 | 8/1977 | Cobaugh et al. | 339/97 R |
| 4,097,106 | 6/1978 | Over et al. | 339/99 R |
| 4,113,341 | 9/1978 | Hughes | 339/147 R |
| 4,118,103 | 10/1978 | Leidy et al. | 339/98 |
| 4,130,331 | 12/1978 | Neff et al. | 339/97 R |
| 4,132,460 | 1/1979 | Porta | 339/119 R |
| 4,159,158 | 6/1979 | Weidler | 339/97 P |
| 4,191,442 | 3/1980 | Caveney et al. | 339/99 R |
| 4,277,124 | 7/1981 | Loose et al. | 339/99 R |
| 4,324,450 | 4/1982 | Weisenburger et al. | 339/97 R |
| 4,344,665 | 8/1982 | Racilla et al. | 339/99 R |
| 4,385,794 | 5/1983 | Lucius | 339/97 R |
| 4,391,484 | 7/1983 | Foederer | 439/404 |
| 4,421,375 | 12/1983 | Coldren | 339/97 R |
| 4,456,317 | 6/1984 | McCleerey | 339/14 R |
| 4,557,544 | 12/1985 | Esser | 339/97 R |
| 4,593,965 | 6/1986 | Joly | 339/192 R |

*Primary Examiner*—David Pirlot

*Attorney, Agent, or Firm*—Robert W. Pitts

[57] ABSTRACT

A stamped and formed terminal for use in establishing an insulation displacemnt termination to wires extending in either of two orthogonal directions is disclosed. The stamped and formed terminal has a box-like conductor terminating portion in which wires can be inserted into slots in opposed plates on two of the four sides. The other plates can then be deformed about weakened sections to overlap a conductor inserted into plates on the adjacent sides to provide strain relief to prevent removal of the wire from the slots. Interconnection to other terminals can then be made to a termination portion which will have the same orientation relative to the insulative body regardless of the direction of the conductors.

9 Claims, 3 Drawing Sheets

BIDIRECTIONAL INSULATION DISPLACEMENT ELECTRICAL CONTACT TERMINAL

BACKGROUND OF THE INVENTION

1. Field of the Invention

This invention relates to insulation displacement terminals made from a flat stamping in which electrical contact with a wire or other conductor is established by the edges of a slot into which an insulated conductor is inserted.

2. Description of the Prior Art

Insulation displacement electrical terminals have been employed successfully in a number of applications. An insulation displacement terminal, normally consists of a stamped and formed member in which a slot is defined by opposed edges. When an insulated wire is inserted into such a slot, the opposed edges penetrate the insulation to establish intimate electrical contact with the underlying core of the insulated conductor. Since the slot edges penetrate the insulation, an insulation displacement terminal can be employed without first having to strip the insulation surrounding the conductive core.

One of the more widely and sucessfully employed insulation displacement terminals employs a terminal in which a slot is stamped in a plate-like member with a conductor being inserted into the slot with the conductor axis locally perpendicular to the plane of the plate-like terminal. The stresses induced in the terminal are not only sufficient to penetrate the insulation surrounding the conductive core of the wire but the slot edges can score or scape metal on the conductor to establish a clean, intimate contact, substantially free from contaminants such as oxide located on the exterior of the wire.

Although conventional insulation displacement contacts have proved suitable for many applications, the fact that the wire is not trapped within the insulation displacement slot formed in the terminal has resulted in some concerns, since the wire is not positively held in place. A number of different techniques have been employed to provide strain relief to the wire so that it cannot move upwardly out of the wire slot. A number of insulation displacement connectors have employed separate plastic strain relief caps to trap the conductors in the slots. U.S. Pat. No. 4,159,158 discloses a connector in which a wire is received in an insulation displacement slot. The insulative connector housing includes projections which prevent upward movement of the wire once it has been inserted into the wire receiving slot. U.S. Pat. No. 4,097,106 discloses an insulation displacement connector in which a portion of the insulative housing is deformed to provide conductor strain relief.

Other insulation displacement terminals have employed upper and lower opposed slots to firmly trap the conductor in place. U.S. Pat. No. 4,324,450 shows the essential features of such a termination. U.S. Pat. No. 4,019,801 discloses a similar configuration in which the conductors are first inserted through holes in the terminal and the terminal is then deformed to force plate-like portions having wire engaging slots down over the wire. Note that in each of these configurations the wire is firmly retained by the terminal itself.

Another technique for providing strain relief to conductors received in an insulation displacement slot is to employ a separate strain relief member which is a part of the terminal itself. U.S. Pat. Nos. 4,456,317; 4,277,124; 4,113,341 and 4,421,375 disclose insulation displacement terminals in which a separate strain relief barrel is crimped around the conductor after termination in an insulation displacement slot.

U.S. Pat. No. 3,950,065 discloses another terminal in which the strain relief is an integral portion of the stamped and formed terminal. This insulation displacement terminal has integral retaining fingers extending from interconnecting straps extending between parallel plates with aligned wire receiving slots. The fingers are angled inwardly and keep a fully inserted wire securely retained within the slot.

U.S. Pat. No. 4,039,239 discloses an insulation displacement terminal in which a wire positioned within an insulation displacement slot is held in place after the clip, in which the slot is located, is inserted over a free standing pin to which the wire is to be interconnected.

Each of these insulation displacement terminals employ a configuration in which the wire is inserted into a slot in a terminal initially held in a fixed position. For example, the terminal will normally be retained within an insulative housing having one or more terminals positioned with outwardly facing wire receiving slots. Insulation displacement slots can also be employed in connectors in which the wire is first secured to the housing and the terminal subsequently inserted. For example, U.S. Pat. No. 3,979,615 discloses an insulation displacement terminal which is inserted into a cavity in an insulative body to engage a wire secured in slots on opposite sides of a cavity. The wire spans the cavity and when the slots engage the conductor, a sound termination is established. Since the wire is trapped between the insulative housing and the terminal, a configuration of this type normally does not require additional wire strain relief. Similar terminals are disclosed in U.S. Pat. Nos. 4,118,103; 4,130,331 and 4,132,460. U.S. Pat. No. 4,557,544 shows a similar terminal having a wire crimp barrel on the opposite end of the terminal and U.S. Pat. No. 3,977,754 discloses a four sided terminal having insulation displacement slots in opposite sides at one end and a poke in contact on the opposite end.

Although each of these terminals is suitable for use in certain applications, there remains a need for simple, cost effective means to provide strain relief to prevent wires from moving upward out of insulation displacement slots. Preferably this strain relief should be provided by the terminal itself since the use of the insulative housing to supply the strain relief could result in relative movement between the conductor and the terminal because of the relative movement between the housing and the terminal itself.

SUMMARY OF THE INVENTION

The stamped and formed terminal for terminating an electrical wire disclosed herein includes an intermediate plate which can be deformed to overlap a conductor positioned in conductor slots in two parallel plates. This terminal can also be used to alternatively terminate electrical conductors oriented in either of two orthogonal directions since the intermediate plate can also have a wire receiving slot. In the preferred embodiment of this invention, a box-like configuration having four sides contains four separate insulation displacement slots. one in each side. By employing such a configuration, a conductor can be inserted into slots in two opposed sides and the remaining adjacent sides can then be folded over to secure the conductor in place. In the preferred embodiment of this invention, a weakened section is formed intermediate the ends of the wire receiving slot and adjacent the upper end of the terminal. This weekend section can be formed by removing material by the simple expedient of stamping one or more holes in the terminal. That portion of the portion extending above the weakened section can then easily be formed over or bent to overlap a conductor received in aligned wire receiving slots of adjacent plates or sides.

A terminal having this configuration can easily be inserted into a cavity in which one or more wires is initially secured in spanning relationship to one of the open ends of the cavity. If the terminal is inserted into the cavity from the end opposite to that in which the conductor is located, the only strain relief provided by the terminal would be provided after the free ends of the terminals are bent to overlap the wires. The capability of such a terminal to engage a wire positioned in one of two orthogonal directions is especially significant when used with a terminal having a mating contact section for engaging a separate terminal. If, for example, this terminal is intended to engage a blade, it would be desirable to have the blade contact engaging section always oriented in the same direction. The capability of having the terminal always oriented in a specified manner would also be significant since the assembly equipment needed to insert the terminals into cavities in the insulative body would be greatly simplified.

DETAILED DESCRIPTION OF THE PREFERRED EMBODIMENT

Figures 1, 2A, 2B:
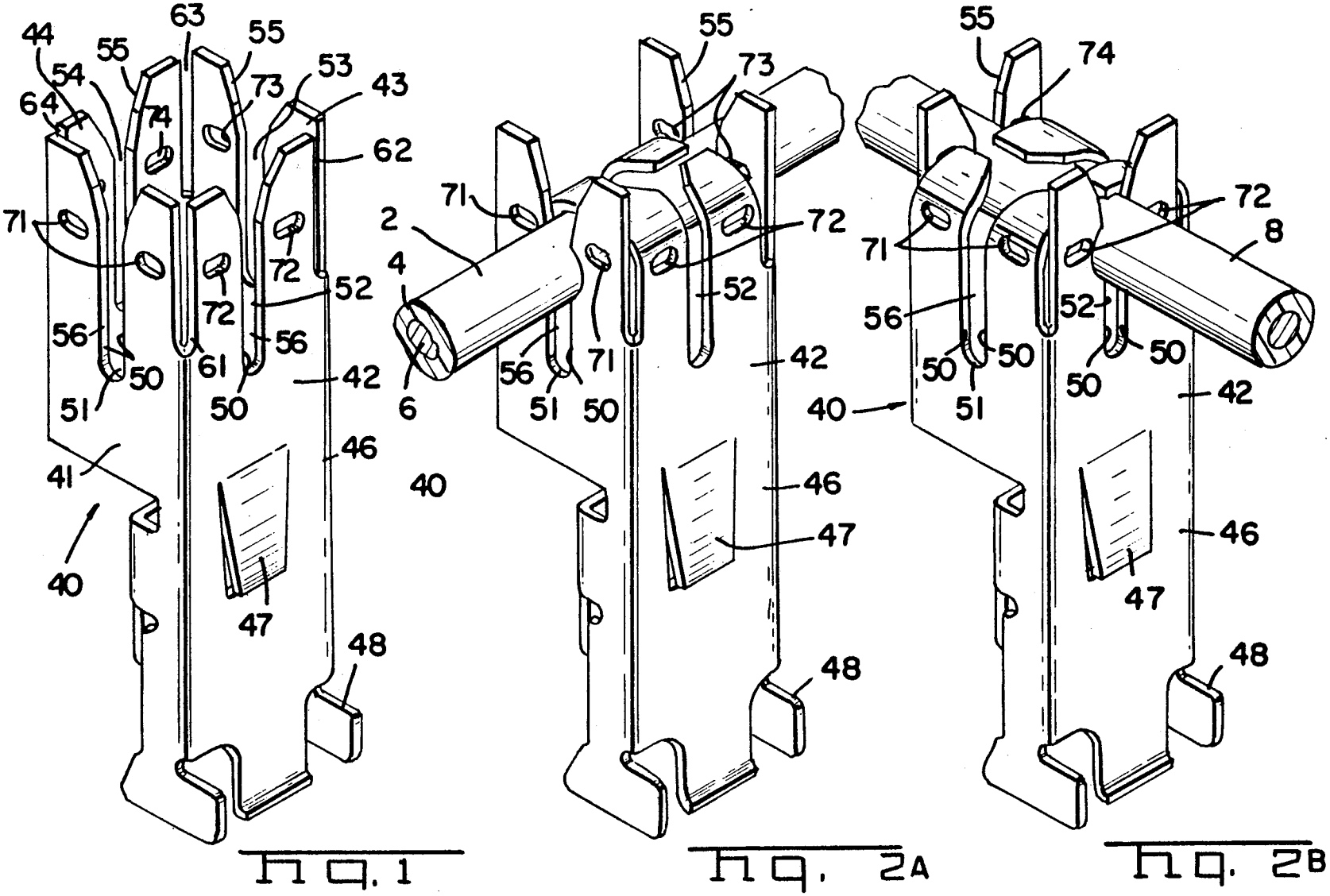
FIG. 1 is a perspective view of the terminal prior to insertion of a wire and deformation of the strain relief.
FIG. 2A and FIG. 2B are perspective views of the terminal according to the preferred embodiment of this invention showing the fact that a wire can be inserted in two orthogonal directions into the same terminal and the terminal can be deformed to provide strain relief in either case.
Figure 3:
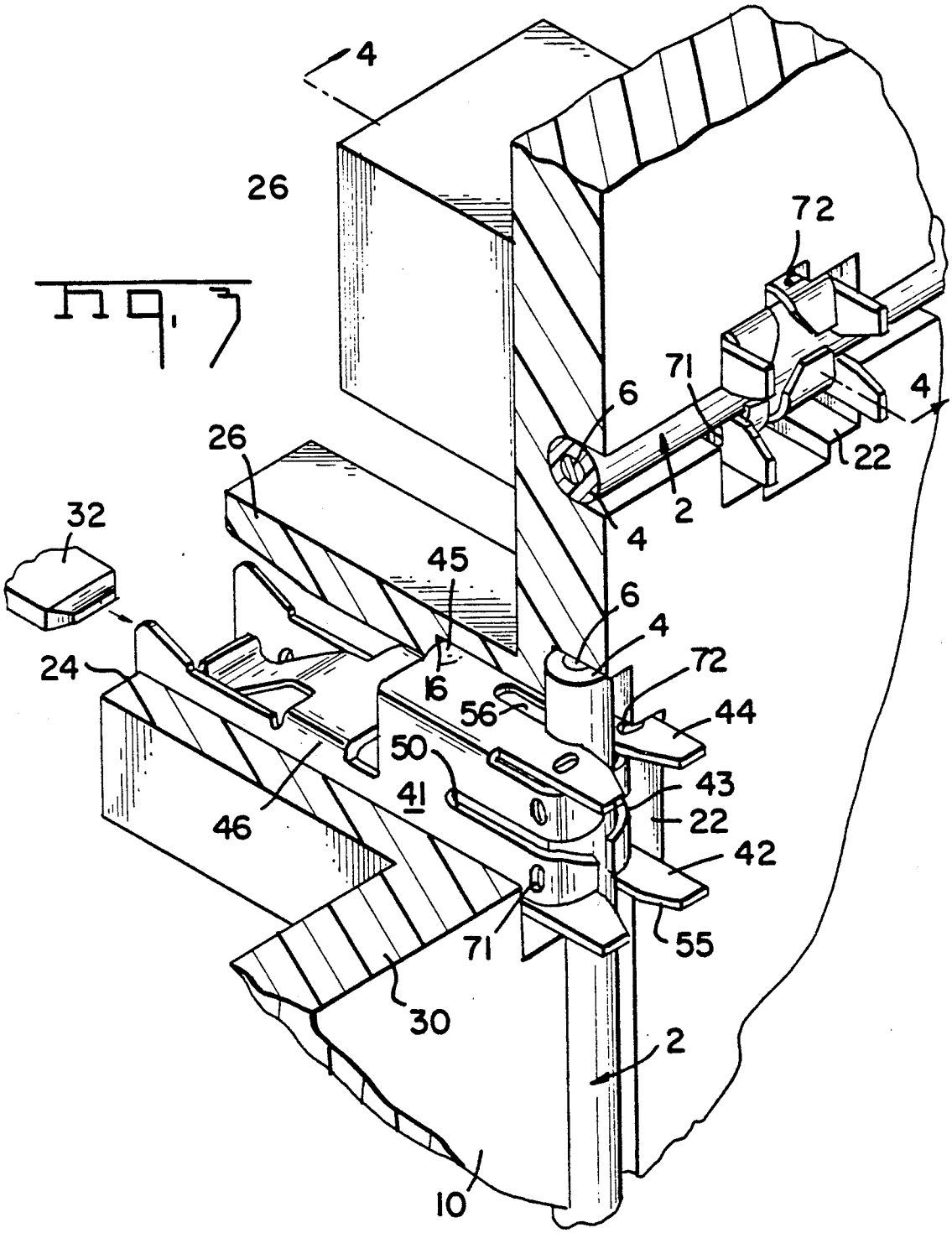
FIG. 3 shows the manner in which wires extending in orthogonal grooves on a panel can be terminated by the terminal.
Figure 4:
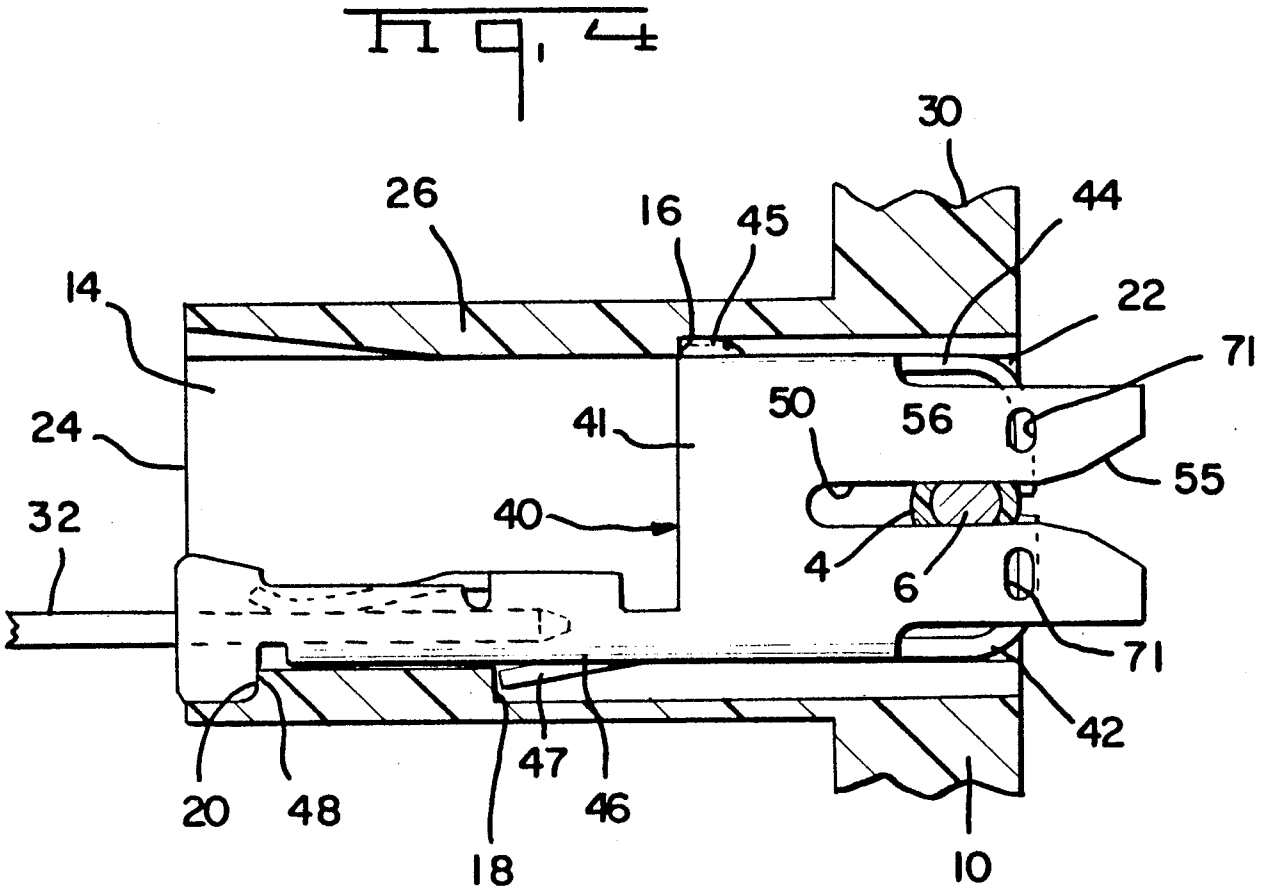
FIG. 4 is a sectional view taken along lines 4—4 in FIG. 3.

An insulation displacement connection to a wire 2 having insulation 4 surrounding the conductor core 6 can be established by a terminal 40 positioned within a cavity 14 in an insulative body 10. In the preferred embodiment of this invention, the wires 2 are positioned within grooves 12 on one surface of the body 10. The wires span an open front end 22 of the cavity 14 when the wires are positioned within grooves 12. The terminal 40 is inserted through the rear open end 24 of the cavity 14 with slots 51, 52, 53, 54 and opposed plates 41, 42, 43, 44 establishing contact with the portion of the insulative conductor 2 spanning the cavity 14.

Each terminal 40 has a conductor terminating portion having a box-like configuration with a generally flat plate 41, 42, 43, 44 on each side of the box-like configuration. Each of the plates 41, 42, 43, 44 has a wire receiving slot 51, 52, 53 54 extending from the first or upper end of the terminal. Relief slots 61, 62, 63, 64 extend from the upper end of the terminal along a portion of the length of the terminal at the corners of the box-like configuration to separate adjacent plates 41, 42, 43, 44. Thus, each of the orthogonal plates 41, 42, 43, 44 are independent and are capable of establishing an independent insulation displacement termination with a conductor received within the conductor receiving slot.

A conductor or wire 2 can be inserted through the conductor entry portion 55 and into the conductor engaging portion 56 of each conductor receiving slot. The edges of the slot defining the conductor entry portion diverge toward the top of each plate to provide a funnel entry for a conductor into the conductor receiving slot. The edges 50 of the conductor engaging portion of the slot are generally parallel and are spaced apart by a distance less than the diameter of the conductive core 6 of a wire to be terminated. Thus, a conventional insulation displacement slot is established. The root of the conductor receiving slots 51, 52, 53, 54, which is the lower portion of the slot, is below the bottom or root of each of the relief slots 60. The relief slots 60 extend generally parallel to the conductor engaging portion 56 of the conductor receiving slot. Thus, the plate sections 41, 42, 43, 44 act independently on opposite sides of each conductor receiving slot 51, 52, 53, 54 to form an independent insulation displacement contact with each conductor 2 or 8.

Each plate 41, 42, 43, 44 has a weakened section formed by a plurality of holes 71, 72, 73, 74 stamped on opposite sides of the conductor receiving slots 51, 52, 53, 54. These stamped holes 71, 72, 73, 74 are located between the upper or free end of each plate 41, 42, 43, 44 and the bottom of the relief slot 61, 62, 63, 64. These weakened sections, formed by holes 71, 72, 73, 74 define a bend line permitting the upper portion of each terminal to be folded over to overlap a conductor extending transversely of the respective plate 41, 42, 43, 44 and being received within the conductor receiving slots 51, 52, 53, 54 of the two adjacent orthogonal plates. In this manner, either of two orthogonal wires 2 and 8 can be terminated be plates extending generally perpendicular to the respective wire and the adjacent plates can be formed over at the bend lines formed at holes 71, 72, 73, 74 to overlap the conductor and provide strain relief for the conductor. It should be understood that a weakened section can be formed in numerous ways and would not depend upon the removal of material by stamping holes 71, 72, 73, 74.

In addition to the box-like configuration of the conductor terminating portion, a terminal contract section extending from the second or lower end of the box-like configuration provides a means for engaging a separate contact member such as a spade terminal 32. The terminal contact section 46 is a generally conventional construction and includes at least one spring contact 49 formed to make electrical contact upon insertion of a spade terminal 32 or other conventional contact. The terminal contact portion 46 extends from the lower edge of one side of the conductor terminating box-like configuration. The terminal contact portion 46 also includes a spring biased latch 47 which normally extends outwardly beyond the profile of one side of the terminal 40. A second spring latch 45 is located on an opposite side of the terminal on one of the plates of the box-like conductor terminating portion. Each of the latches 45, 47 is adapted to be biased inwardly upon the exertion of a force on an inclined outwardly facing surface. A stop shoulder 48 is located on the lower end of the terminal contact portion 46. Each cavity 14 has a plurality of shoulders located on the walls 26 of the cavity. A first latch retention shoulder is located in a position to engage the latch 45 at the base of one of the plates of the conductor termination portion. The second latch shoulder, also facing towards a front open end 22 of the cavity 14, is positioned to engage the latch 47 on the terminal contact 46. A latch stop shoulder 20 facing toward the rear open end 24 of the cavity 14 is located adjacent rear open end 24. The terminal 40 is adapted to be inserted into the cavity 14 through the rear open end 24. Latches 45 and 47 are inwardly deflected during insertion of terminal 40 in the cavity 14. Upon complete insertion of terminal 40 in the cavity 14, latches 45 and 47 spring open to engage shoulders 16 and 18, respectively. Stop shoulder 20 engages the latch stop shoulder 48 to prevent further insertion of the terminal 40.

When the terminal is fully inserted, the free ends of the terminals containing the conductor entry portions 55 of slots 51, 52, 53, 54 each extend beyond the front open end 22 of cavity 14 and beyond the surface of the insulative body 10. Conductors 2 and 8 have previously been positioned within grooves 12 on a panel 30 from which the housings defining each cavity 14 extend. The conductors 2 and 8 positioned within grooves 12 are located so that they will span the front open end 22 of each cavity 14 in one of two orthogonal directions. Insertion of the terminal 40 into the cavity 14 will result in engagement of one of the conductors 2 and 8 and the conductors will thus be inserted into the wire engaging slot portion 56 into engagement with the edges 50 of the slots to establish an intimate insulation displacement connection. Note that when the terminals 40 are fully inserted, the weakened section formed along stamped holes 71, 72, 73, 74 are substantially in line with the front open end 22 of each cavity 18. Thus, the portion of the respective plates which extend generally parallel to the wire can be deformed to overlap the conductor and act as strain reliefs for a wire inserted into the slots in the orthogonal planes.

By providing a box-like configuration having plates oriented in two orthogonal directions to engage conductors located in one of two orthogonal directions, it is possible to insert a terminal, such as terminal 40, into all of the cavities 14 in insulative body 10 in the same orientation. Thus, the terminal contact portion 46 will always be positioned in the same orientation and can receive separate terminals, such as spade terminal 32, all oriented in the same direction. Re-orientation of the individual terminal, even when the wires extend in orthogonal directions, is then unnecessary. By maintaining the terminals in the same general orientation, the installation equipment for individual terminals into the insulative bodies is simplified and it is much easier to make the final termination of terminals 32 to the terminals 40 if the orientation is always the same. It should be appreciated that the strain relief means employed in this unique box-like configuration terminal is not limited to use in a terminal having the terminal contact portion 46, as shown in the preferred embodiment of this invention. Therefore, the claims dependent hereto are not limited to the preferred embodiment depicted herein but are directed to other embodiments which would be contemplated in light of this disclosure by one skilled in the art.

We claim:

1. A stamped and formed terminal for terminating an electrical conductor comprising: first and second spaced apart plates, each having a conductor receiving slot extending inwardly from a first end of the terminal and strain relief means for retaining a conductor in each of the conductor receiving slots, the strain relief means comprising third and fourth plates extending transversely between the first and second plates, the terminal being formed into a box configuration with the first and second plate being opposed and the third and fourth plate being opposed, the first, second, third and fourth plates being joined at a second end, the third and fourth plates being separated from the first and second plates at the first end, a portion of the third and fourth plates being deformable relative to the first and second plates at the first end to overlap a conductor positioned in the conductor receiving slots in the first and second plates in engagement with the terminal.

2. The terminal of claim 1 wherein the box configuration is formed by bending a flat stamping, the edges of the flat stamping defining the edges of the first and fourth plates, the edges of the first and fourth plates being adjacent at one corner of the box configuration, the terminal further comprising a tab on the fourth plate positioned within a cutout on the first plate to anchor the fourth plate to the first plate.

3. A terminal for terminating an electrical conductor oriented in either of two orthogonal directions, comprising at least two orthogonal plates, each plate having a conductor receiving slot extending inwardly from one end to a root of the conductor receiving slot and a weakened section between the one end and the root of the conductor receiving slot, the weakened section defining a bend line so that the portion of each plate between the weakened section and the one end can be deformed to overlap a conductor positioned in the conductor receiving slot of the other plate.

4. The terminal of claim 3 wherein the weakened section is formed by removing material adjacent the conductor receiving slot.

5. The terminal of claim 3 wherein edges of each conductor receiving slot diverge adjacent the one end to form a conductor entry section, the edges being parallel from the conductor entry section to the root of the slot to define a conductor engaging section, the weakened section being located at the juncture of the cable entry section and the conductor engaging section.

6. The terminal of claim 5 wherein the weakened section comprises at least one hole adjacent the conductor receiving slot.

7. The terminal of claim 3 wherein the orthogonal plates are formed by bending a flat stamping, a relief slot being stamped adjacent the one end at a corner of the two orthogonal plates to allow the portion of each plate between the weakened section and the one end to overlap a conductor positioned within the conductor receiving slot of the other plate.

8. The terminal of claim 7 wherein the depth of the relief slot is less than the depth of the conductor receiving slot.

9. An assembly including at least one stamped and formed terminal for terminating at least one electrical conductor oriented in either of two orthogonal directions and an insulative body; the terminal comprising a conductor terminating portion having a box configuration defined by bending a flat stamping to define four sides, each side having a conductor receiving slot extending inwardly from one end, and a terminal contact section extending from one of the sides of the conductor terminating portion, the edges of each of the sides being separate from the edges of the adjacent sides at the one end wherein the portion of each side adjacent to the one end can be bent to overlap a conductor positioned within the conductor receiving slot of an adjacent side, the body including at least one cavity including means for receiving a terminal with the terminal contact section having only one orientation relative to the body, the cavity having first and second opposite open ends, the body having means for anchoring a conductor spanning the first open end and means for latching a terminal inserted into the cavity from the second open end, a conductor entry portion of each side adjacent the one end extends beyond the first open end of the cavity, the conductor entry portions of each side being deformable to overlap a conductor positioned within the conductor receiving slot of the adjacent side, whereby conductors in either of two orthogonal directions can be received within a conductor receiving slot without changing the orientation of the terminal contact section relative to the body.

* * * * *